US010960278B2

(12) United States Patent
Serrano et al.

(10) Patent No.: US 10,960,278 B2
(45) Date of Patent: Mar. 30, 2021

(54) PUTTER GOLF CLUB HEAD WITH ELASTOMER FILL

(71) Applicant: KARSTEN MANUFACTURING CORPORATION, Phoenix, AZ (US)

(72) Inventors: Anthony D. Serrano, Anthem, AZ (US); Les J. Bryant, Peoria, AZ (US); Guillermo G. Vald'Via, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/140,352

(22) Filed: Sep. 24, 2018

(65) Prior Publication Data

US 2019/0091527 A1 Mar. 28, 2019

Related U.S. Application Data

(60) Provisional application No. 62/562,300, filed on Sep. 22, 2017.

(51) Int. Cl.

| | |
|---|---|
| ***A63B 53/04*** | (2015.01) |
| ***A63B 60/50*** | (2015.01) |
| ***A63B 60/02*** | (2015.01) |
| ***A63B 53/06*** | (2015.01) |
| ***A63B 60/54*** | (2015.01) |
| *A63B 60/00* | (2015.01) |

(52) U.S. Cl.

CPC ..... *A63B 53/0487* (2013.01); *A63B 53/065* (2013.01); *A63B 60/02* (2015.10); *A63B 60/50* (2015.10); *A63B 60/54* (2015.10); *A63B 53/042* (2020.08); *A63B 53/0433* (2020.08); *A63B 60/002* (2020.08); *A63B 2209/00* (2013.01)

(58) Field of Classification Search

CPC ..... A63B 2053/002; A63B 53/007; A63B 53/00487; A63B 60/02; A63B 60/50; A63B 60/54; A63B 53/065; A63B 60/002; A63B 53/0433; A63B 53/042; A63B 2209/00

See application file for complete search history.

(56) References Cited

U.S. PATENT DOCUMENTS

| | | | | |
|---|---|---|---|---|
| 3,815,910 A * | 6/1974 | Raines | A63B 53/007 | 473/313 |
| 4,535,990 A * | 8/1985 | Yamada | A63B 53/04 | 473/346 |
| 4,553,755 A * | 11/1985 | Yamada | A63B 53/04 | 473/338 |
| 4,722,528 A * | 2/1988 | Tsao | A63B 53/0487 | 473/254 |

(Continued)

FOREIGN PATENT DOCUMENTS

| | | |
|---|---|---|
| JP | 2000245876 | 9/2000 |
| JP | 2001204856 | 7/2001 |

(Continued)

OTHER PUBLICATIONS

The Grund Company—Elastomeric Materials, http://thegundconnpany.com/materials/flexible-materials/elastomeric-materials, Jun. 2019.*

*Primary Examiner* — William M Pierce

(57) ABSTRACT

Embodiments of putter golf club heads with an elastomer is enclosed herein. Other embodiments and methods may be described and claimed.

18 Claims, 7 Drawing Sheets

(56) References Cited

U.S. PATENT DOCUMENTS 4,778,185 A * 10/1988 Kurokawa ..... A63B 53/04 473/332
5,078,398 A 1/1992 Reed et al.
5,178,392 A * 1/1993 Santioni ..... A63B 53/04 273/153 R
5,244,211 A * 9/1993 Lukasiewicz ..... A63B 53/04 473/305
5,273,283 A 12/1993 Bowland
5,306,450 A * 4/1994 Okumoto ..... A63B 53/04 264/45.1
5,547,194 A * 8/1996 Aizawa ..... A63B 53/04 473/350
5,776,010 A 7/1998 Helmstetter et al.
5,807,188 A 9/1998 Serrano et al.
5,857,922 A * 1/1999 Delio ..... A63B 53/0487 473/313
6,089,992 A * 7/2000 Onuki ..... A63B 53/04 473/324
6,306,048 B1 * 10/2001 McCabe ..... A63B 53/04 473/333
6,422,950 B1 7/2002 Whitlam
6,616,547 B2 9/2003 Vincent et al.
6,729,971 B2 * 5/2004 Caldwell ..... A63B 53/04 473/324
6,921,343 B2 7/2005 Solheim
7,083,526 B2 8/2006 Durnin
7,134,971 B2 11/2006 Franklin et al.
7,338,388 B2 * 3/2008 Schweigert ..... A63B 53/0466 473/342
7,364,514 B2 * 4/2008 Yamaguchi ..... A63B 53/0487 473/340
7,393,287 B2 7/2008 Huang
7,749,101 B2 7/2010 Imamoto et al.
7,887,432 B2 * 2/2011 Jones ..... A63B 53/0487 473/324
7,922,604 B2 * 4/2011 Roach ..... A63B 53/047 473/350
8,172,695 B2 * 5/2012 Cameron ..... A63B 53/02 473/244
8,535,177 B1 * 9/2013 Wahl ..... A63B 60/00 473/350
8,808,107 B2 * 8/2014 Abe ..... A63B 53/0466 473/342
8,961,336 B1 * 2/2015 Parsons ..... A63B 53/0475 473/332
9,199,140 B1 * 12/2015 Schweigert ..... A63B 53/0466
9,415,280 B2 * 8/2016 Stokke ..... A63B 60/42
9,808,685 B1 * 11/2017 Westrum ..... A63B 53/047
9,827,469 B1 * 11/2017 Seluga ..... A63B 53/0466
9,901,788 B2 * 2/2018 Franklin ..... A63B 53/047
9,901,792 B2 * 2/2018 Franklin ..... A63B 53/0466
9,956,463 B2 * 5/2018 Franklin ..... A63B 60/54
10,195,501 B2 * 2/2019 Parsons ..... A63B 53/0466
2003/0022730 A1 * 1/2003 Nelson ..... A63B 60/54 473/332
2005/0192116 A1 * 9/2005 Imamoto ..... A63B 53/0475 473/329
2005/0233829 A1 10/2005 Cameron
2007/0243950 A1 * 10/2007 Billings ..... A63B 53/0487 473/340
2007/0281796 A1 12/2007 Gilbert et al.
2008/0020861 A1 * 1/2008 Adams ..... A63B 53/04 473/334
2008/0058117 A1 * 3/2008 Roach ..... A63B 53/047 473/332
2013/0109500 A1 5/2013 Boyd et al.
2014/0038744 A1 * 2/2014 Leatt ..... A63B 60/46 473/329
2014/0045607 A1 * 2/2014 Hilton ..... A63B 53/04 473/332
2015/0024864 A1 * 1/2015 Jertson ..... A63B 60/02 473/291
2015/0231454 A1 * 8/2015 Parsons ..... A63B 53/0475 473/335
2015/0231806 A1 * 8/2015 Parsons ..... B29C 45/14467 264/261
2016/0059090 A1 * 3/2016 Parsons ..... A63B 53/0466 473/338
2018/0221725 A1 * 8/2018 Westrum ..... A63B 53/0475
2018/0221726 A1 * 8/2018 Westrum ..... A63B 53/0475
2019/0201754 A1 * 7/2019 Hoffman ..... A63B 53/0466

FOREIGN PATENT DOCUMENTS

KR 20130128653 11/2013
WO 2005061057 7/2005

* cited by examiner

PUTTER GOLF CLUB HEAD WITH ELASTOMER FILL

CROSS-REFERENCE TO RELATED APPLICATIONS

This claims the benefit of U.S. Provisional Patent Appl. No. 62/562,300, filed on Sep. 22, 2017, the contents of which are incorporated fully herein by reference.

FIELD OF INVENTION

The present disclosure relates generally to golf clubs, and more particularly, to putter golf club heads with an elastomer fill.

BACKGROUND

In many putter-type golf club heads, there is a use of a weight distribution device, in order to vary the center of gravity or increase the moment of inertia (MOI) of the golf club head. Common weight distribution devices include removable weight ports in the heel and toe regions of the sole, weighted faceplate inserts, inserts for the back of portion of the face, and attachments for the outer perimeter of the toe and heel regions. In particular putter-type golf club heads, often use weight ports in the heel and toe regions that can be removable attached by a fastener, or permanently attached through a variety of epoxies, glues, or machining methods. Through the use of weight ports in the heel and toe regions, the MOI is increased in the putter head, thus producing a straighter ball path after impact.

Although these weight ports in the heel and toe regions increase MOI, they increase the weight of the golf club head and can make the golf club head heavier than an ideal weight. In addition, installing weight ports into a golf club head requires a cavity or recess to place these weight ports into with increased manufacturing costs. Additionally, the weight ports can cause vibrations within the cavity or recess during impact, when the golf club head contacts a golf ball. These cavities and recesses can cause the sound of the club head to change as well, creating a hollow sound within the club head. There is a need in the art to develop a putter having perimeter weighting and having an ideal weight for balanced putting without adding complicated structures such as weight ports.

Figure 1:
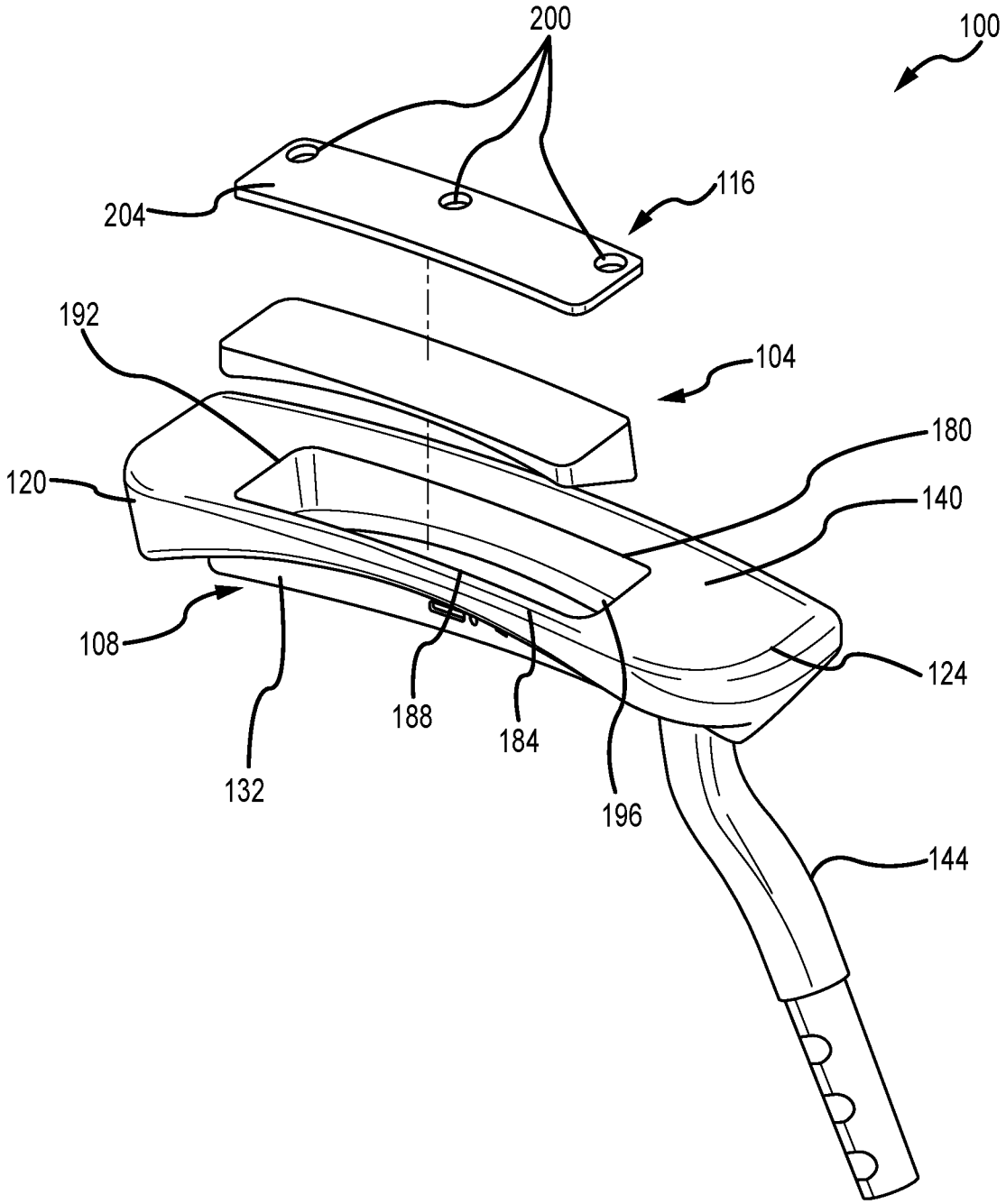
FIG. 1 illustrates an embodiment of a putter type golf club head with elastomer fill.

Other aspects of the disclosure will become apparent by consideration of the detailed description and accompanying drawings.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure. The same reference numerals in different figures denote the same elements.

DETAILED DESCRIPTION

Described herein is a golf club head having a cavity with a lightweight polymer fill positioned in the golf club head. The golf club head comprises a cavity in a sole portion of the club head, a soleplate containing one or more apertures over the cavity, and a lightweight polymer injected into the cavity. The sole cavity, filled with an impressionable polymer, can optimize the MOI of the club head about the y-axis (Iyy), while maintaining an ideal weight for a golf club head. Further, one or more suspended members can be displaced within the polymer to improve the sound and feel of the golf club head when it strikes a golf ball.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

FIGS. 1-7 illustrate an embodiment of a golf club head 100 having a cavity 112 with an elastomer fill 104. In many embodiments, the golf club head 100 can comprise a putter type golf club head, wherein the putter head can be mallet-type putter head, mid-mallet type putter head, a blade type putter head, a high MOI putter, or any type of putter head.

In many embodiments, the putter type golf club head can have a loft angle less than 10 degrees. In many embodiments, the loft angle of the club head can be between 0 and 5 degrees, between 0 and 6 degrees, between 0 and 7 degrees, or between 0 and 8 degrees. For example, the loft angle of the club head can be less than 10 degrees, less than 9 degrees, less than 8 degrees, less than 7 degrees, less than 6 degrees, or less than 5 degrees. For further example, the loft angle of the club head can be 0 degrees, 1 degree, 2 degrees, 3 degrees, 4 degrees, 5 degrees, 6 degrees, 7 degrees, 8 degrees, 9 degrees, or 10 degrees.

The golf club head 100 comprises a putter body 108, a cavity 112 in the putter body 108, a sole plate 116 enclosing the putter body 108, and an elastomer fill 104 positioned within the cavity 112. The putter body 108 comprises a toe end 120 and a heel end 124 opposite the toe end 120. The putter body 108 can have a strike face 128 and a rear periphery 132 opposite the strike face 128. Further, the putter body 108 can have a top surface 136 and a sole 140 opposite the top surface 136. Furthermore, the putter body 108 can have a cavity 112 positioned perpendicular to the sole 140 and a hosel 144 attached to the top surface 136.

In many embodiments, the golf club head 100 can have a weight that ranges between 340 and 365 grams. In other embodiments, the golf club head 100 can range between 340 grams-345 grams, 345 grams-350 grams, 350 grams-355 grams, 355 grams-360 grams, or 360 grams-365 grams. In some embodiments, the weight of the golf club head 100 can be 340 grams, 341 grams, 342 grams, 343 grams, 344 grams, 345 grams, 346 grams, 347 grams, 348 grams, 349 grams, 350 grams, 351 grams, 352 grams, 353 grams, 354 grams, 355 grams, 356 grams, 357 grams, 358 grams, 359 grams, 360 grams, 361 grams, 362 grams, 363 grams, 364 grams, or 365 grams.

I. Body

Referring to FIGS. 1-6, the body of the putter type golf club head 100 is discussed below. The putter type club head 100 comprises of the body 108. The putter body 108 can comprise a toe end 120. The putter body 108 can comprise a heel end 124. The putter body 108 can comprises a strike face 128. Further, the putter body 108 can comprise a rear periphery 132. Furthermore, the putter body 108 can comprise a hosel 144. The toe end 120 and heel end 124 are connected by the strike face 128 and the rear periphery 132. The toe end 120 is opposite the heel end 124, and the strike face 128 is opposite the rear periphery 132. The rear periphery 132 and strike face 128 are connected by the top surface 136 and sole 140 of the putter body 108. The hosel 144 of the putter body 108 is attached perpendicular to the top surface 108, on the heel end 124 of the putter body 108.

The strike face 128 of the putter body 108 comprises a strike face center point 148 and a loft plane 152. The strike face center point 148 is equidistant from the top surface 136 and sole 140 of the putter body 108, as well as equidistant from the heel end 124 and toe end 120 of the putter body 108. The loft plane 152 is tangent to the strike face 128 of the putter body 108. Further, a midplane 156 intersects the strike face center point 148 and is perpendicular to the loft plane 152. Furthermore, a y-axis 160 intersects the strike face center point 148, and is perpendicular to a ground plane 164, wherein the ground plane 164 is tangent to the sole 140, when the putter body 108 is at an address position to strike a golf ball.

The rear periphery 132 of the putter body 108 comprises a contour 168 and a rear plane 172. The contour 168 of the rear periphery 132 is the bounding shape that is made by the rear periphery 132, as the rear periphery 132 connects the heel end 124 of the putter body 108 to the toe end 120 of the putter body 108. In some embodiments, the contour 168 can be linear, curvilinear, semi-circular, parabolic, or any other desired shape for the rear periphery 132. In one embodiment, the rear periphery 132 is parallel to the strike face 128 and the rear contour 168 is linear. Further, the rear plane 172 is tangent to the rear periphery 132 and perpendicular to the ground plane 164.

The top surface 136 of the putter body 108 spans from the toe end 120 of the putter body 108 to the heel end 124 of the putter body 108 and generally parallel to the ground plane 164. In some embodiments, the top surface 136 can have any one or combination of the following: a perfectly flat top surface 136, a slight camber towards the rear and towards the strike face 128, a slope from the toe end 120 to the heel end 124 of the putter body 108, a slope towards the rear periphery 132 of the putter body 108, an arch towards the rear periphery 132 of the putter body 108, or an alignment indicium 176 located an equidistance from the heel end 124 to the toe end 120 of the top surface 136.

The sole 140 of the putter body 108 spans from the toe end 120 of the putter body to the heel end 124 of the putter body 108 and is opposite of the top surface 136. The sole 140 of the putter body 108 is tangent to the ground plane 164. In some embodiments, the sole 140 of the putter body 108 can be perfectly flat, can have a slight arch in a heel 124 to toe 120 direction, or can have a strong arch in the heel 124 to toe 120 direction. The sole 140 functions to provide a surface to rest the putter body 108 on the ground plane 164. Additionally, the sole 140 contains the cavity 112 perpendicular to the sole 140 that spans towards the top surface 136 of the putter body 108. Furthermore, the sole 140 can comprise a soleplate 116, wherein the soleplate 116 is flush with the sole 140 and covers the cavity 112.

The putter body 108 is made of a first material or combination of a first material and another metal. The first material of the putter body 108 can be any one or more combination of the following: 8620 alloy steel, S25C steel, carbon steel, maraging steel, 17-4 stainless steel, 1380 stainless steel, 303 stainless steel, stainless steel alloy, tungsten, aluminum, aluminum alloy, or any metal suitable for creating a golf club head. In one embodiment, the putter body 108 is made of 1380 stainless steel or 303 stainless steel.

II. Cavity

Figure 2:
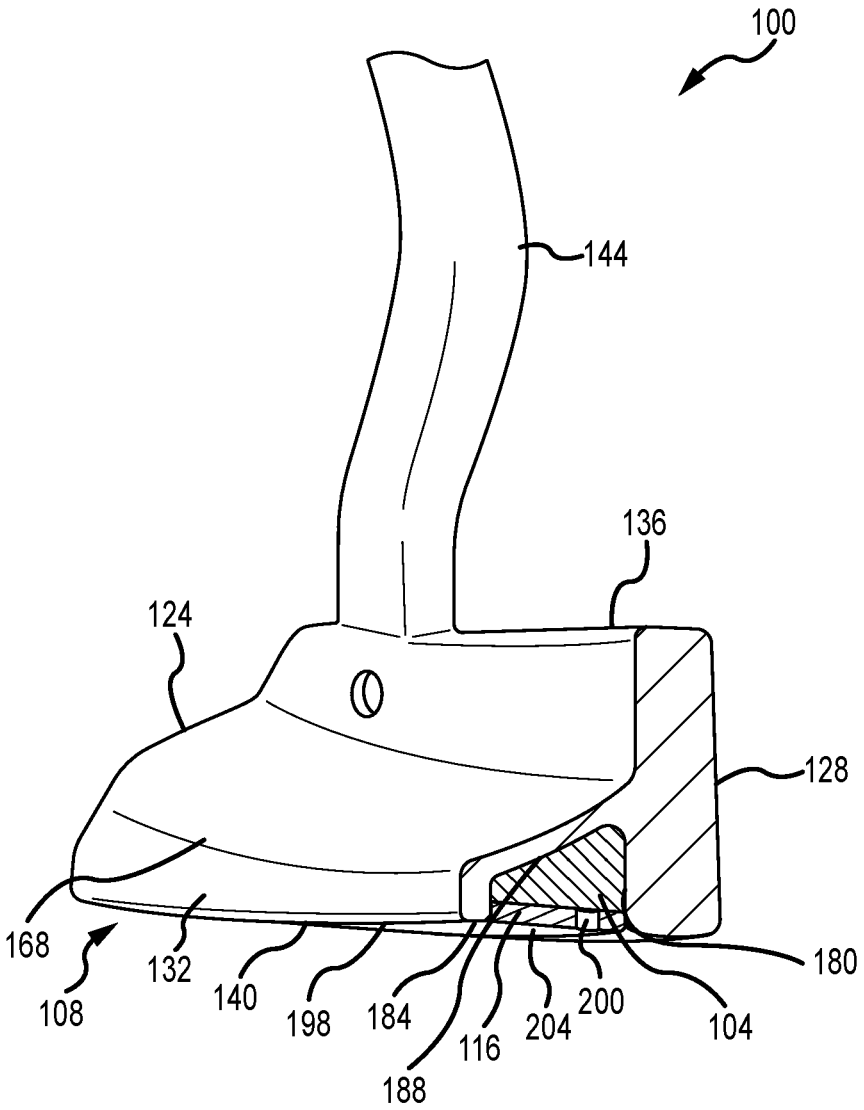
FIG. 2 illustrates a cross-section view of the putter type golf club head with elastomer fill of FIG. 1.
Figure 3:
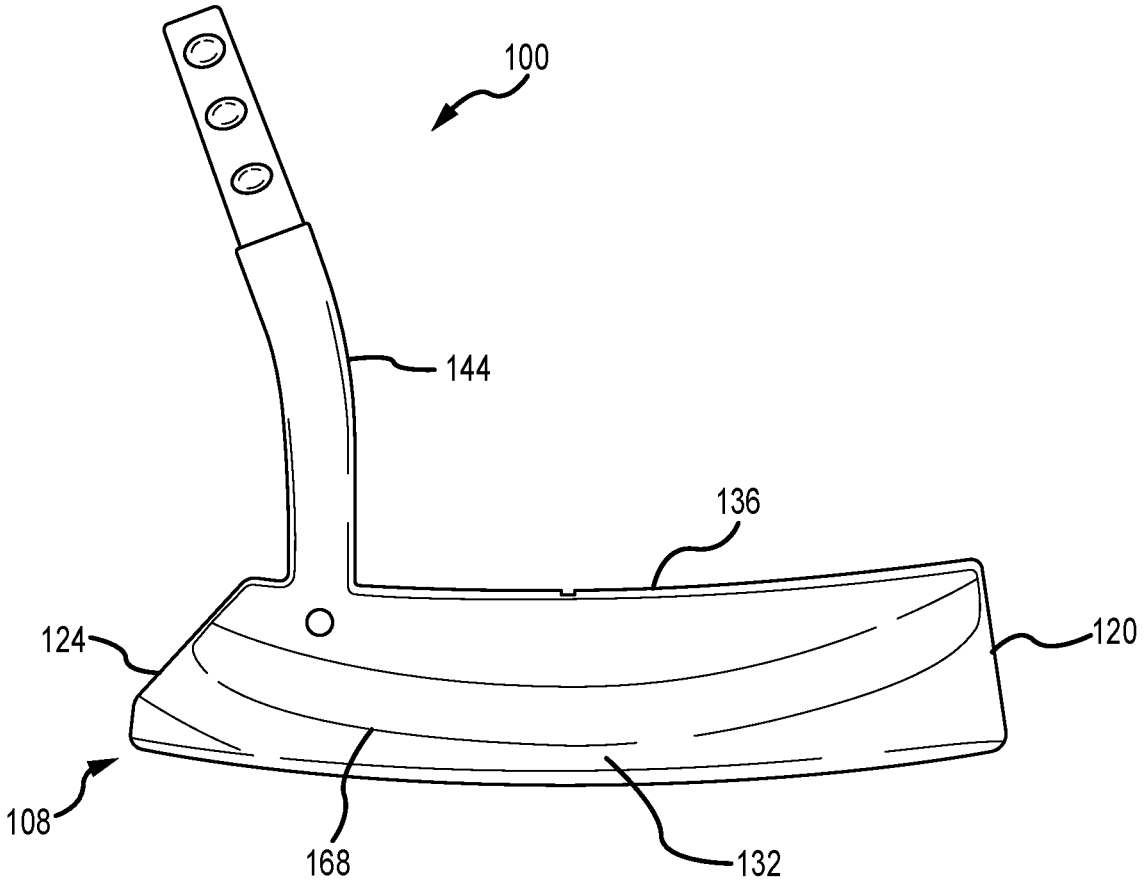
FIG. 3 illustrates a rear view of the putter type golf club head with elastomer fill of FIG. 1.
Figure 7B:
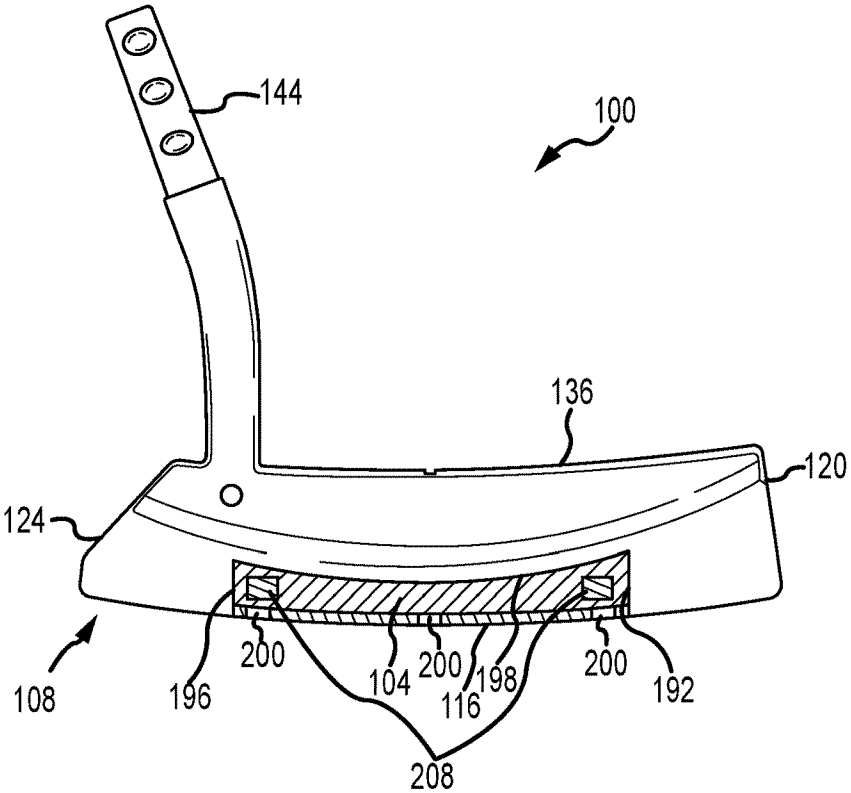
FIG. 7B illustrates another cross-section view of the rear view of the putter type golf club head with elastomer fill of FIG. 1.
Figure 7A:
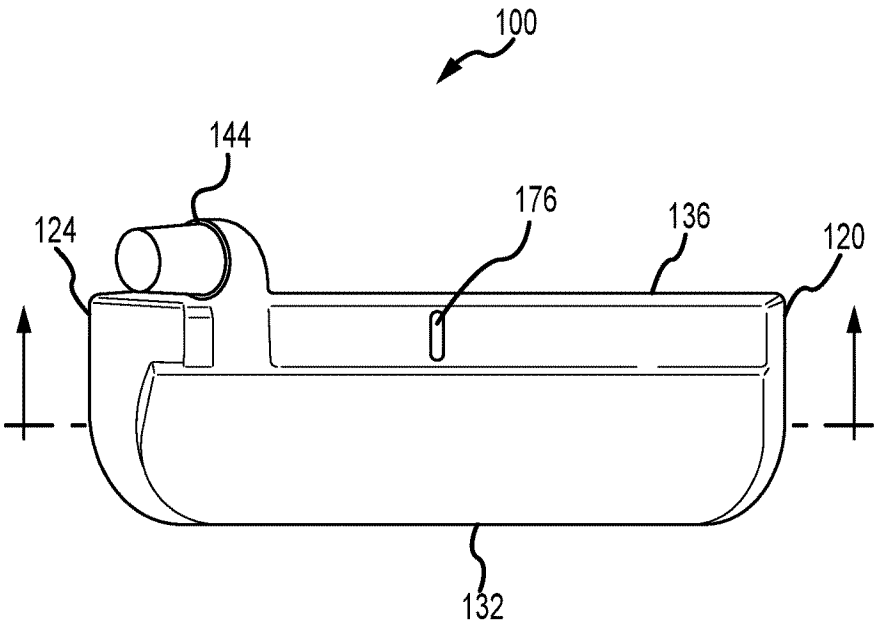
FIG. 7A illustrates a top view of the putter type golf club head with elastomer fill of FIG. 1.

Referring to FIGS. 1, 2, and 7, the sole 140 of the putter body 108 has a cavity 112. The cavity 112 of the putter body 108 comprises a front wall 180 and a back wall 184 opposite the front wall 180. The cavity 112 can have a top wall 188 connecting the front wall 180 and back wall 184. Further, the cavity 112 can have a toe side wall 192 and a heel side wall 196 opposite the toe side wall 192. Furthermore, the cavity 112 has a length, a height, and a width. In some embodiments, the cavity 112 can contain an elastomer fill 104. In one embodiment, the cavity 112 is positioned perpendicular to the sole 140, wherein the toe side wall 192, heel side wall 196, front wall 180, and back wall 184 are perpendicular to the ground plane 164. In other embodiments, the cavity 112 can be positioned at any angle relative to the sole 140. Further, in one embodiment, the cavity 112 can be positioned equidistant from the toe end 120 and heel end 124 of the putter head 108. In other embodiments, the cavity 112 can be positioned closer to the toe end 120 or closer to the heel end 124 of the putter body 108.

Furthermore, the front wall 180 of the cavity 112 is positioned a distance from the strike face 128 and loft plane 152. In many embodiments, the front wall 180 cavity 112 can be positioned between 0.250 inches and 0.450 inches away from the strike face 128 and the loft plane 152. In some embodiments, the front wall 180 of the cavity 112 can be positioned 0.250 inches-0.275 inches, 0.275 inches-0.300 inches, 0.300 inches-0.325 inches, 0.325 inches-0.350 inches, 0.350 inches-0.375 inches, 0.375 inches-0.400 inches, 0.400 inches-0.425 inches, or 0.425 inches-0.450 inches away from the strike face 128 and the loft plane 152. Having the front wall 180 cavity 112 distanced from the strike face 128 and loft plane 152, ensures that the cavity 112 does not affect the material properties or performance of the strike face 128.

The length of the cavity 112 is measured in a heel 124 to toe 120 direction, from the toe side wall 192 to the heel side wall 196. In some embodiments, the length of the cavity 112 in the putter body 108 can range from 0.50 inches to 3.5 inches. In other embodiments, the length of cavity 112 in the putter body 108 can range from 0.50 inches-1.0 inches, 1.0 inches-1.5 inches, 1.5 inches-2.0 inches, 2.0 inches-2.5 inches, 2.5 inches-3.0 inches, or 3.0 inches-3.5 inches. In one embodiment, the length of the cavity 112 ranges between 2.0 inches and 2.5 inches.

The width of the cavity 112 is measured from the front wall 180 to the back wall 184 of the cavity 112. In some embodiments, the width of the cavity 112 in the putter body 108 can range from 0.125 inches to 1.00 inches. In other embodiments, the width of the cavity 112 in the putter body 108 can range from 0.125 inches-0.250 inches, 0.250 inches-0.375 inches, 0.375 inches-0.500 inches, 0.500 inches-0.625 inches, 0.625 inches-0.750 inches, 0.750 inches-0.875 inches, 0.875 inches-1.000 inches. In one embodiment, the width of the cavity 112 in the putter body 108 can range between 0.500 inches and 0.625 inches.

The height of the cavity 112 is measured from the sole 140 of the putter body 108 to the top wall 188 of the cavity 112. The height of the cavity 112 can be the same across the top wall 188 of the cavity 112, or the height of the cavity 112 can vary across the top wall 188 of the cavity 112. In some embodiments, the height of the cavity 112 can range between 0.05 inches and 0.50 inches. In other embodiments, the height of the cavity 112 can range between 0.05 inches-0.10 inches, 0.10 inches-0.15 inches, 0.15 inches-0.20 inches, 0.20 inches-0.25 inches, 0.25 inches-0.30 inches, 0.30 inches-0.35 inches, 0.35 inches-0.40 inches, 0.40 inches-0.45 inches, 0.45 inches-0.50 inches. In one embodiment, the height of the cavity 112 is higher on the toe end 120 than the heel end 124.

The front wall 180 of the cavity 112 spans parallel to the back wall 184 of the cavity 112, and perpendicular to the ground plane 164. The front wall 180 of the cavity 112 has a greater height than the back wall 184 of the cavity 112. The front wall 180 and back wall 184 of the cavity 112 do not intersect with the midplane 156. Furthermore, the front wall 180 of the cavity 112 can be any geometric shape, wherein the front wall 180 corresponds to a contour 198 of the top wall 188 of the cavity 112.

The contour 198 of the top wall 188 of the cavity 112 is the bounding shape that is made by the top wall 192, as the top wall 188 connects the heel side wall 196 of the cavity to the toe side wall 190 of the cavity 112. In some embodiments, the contour 198 can be linear, curvilinear, semi-circular, parabolic, or any other desired shape for the cavity 112. Additionally, the top wall 188 of the cavity 112 does not intersect with the midplane 156, thus the entire cavity 112 is beneath the midplane 156 of the putter body 108.

Further, the cavity 112 is positioned closer to the rear periphery 132 than the strike face 128. In some embodiments, the distance from the rear wall 184 of the cavity 112 to the rear periphery 132 ranges between 0.025 inches and 0.625 inches. In other embodiments, the distance from the rear wall 184 of the cavity 112 to the rear periphery 132 ranges between 0.025 inches-0.075 inches, 0.075 inches-0.125 inches, 0.125 inches-0.175 inches, 0.175 inches-0.225 inches, 0.225 inches-0.275 inches, 0.275 inches-0.325 inches, 0.325 inches-0.375 inches, 0.375 inches-0.425 inches, 0.425 inches-0.475 inches, 0.475 inches-0.525 inches, 0.525 inches-0.575 inches, or 0.575 inches-0.625 inches. In one embodiment, the distance from the rear wall 184 of the cavity 112 to the rear periphery 132 ranges between 0.075 inches and 0.125 inches.

The cavity 112 functions to move the weight distribution of the putter body 108 towards the heel end 124 and toe end 120 of the putter body 108, thus improving the MOI and CG of the putter body 108. Incorporating the cavity 112 into the putter body 108, increases the MOI about the y-axis by approximately 9.5% (MOI=680 lb·ft$^2$) compared to a similar putter body (350 grams) devoid of a cavity 112 (MOI=621 lb·ft$^2$).

III. Soleplate

Figure 4:
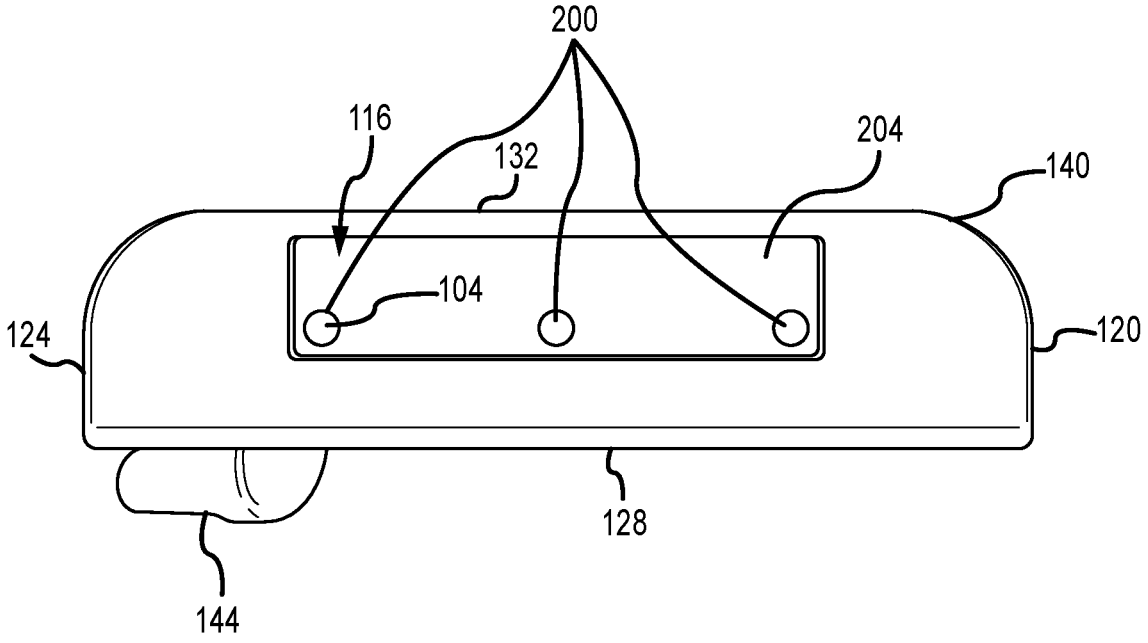
FIG. 4 illustrates a sole view of the putter type golf club head with elastomer fill of FIG. 1.
Figure 5:
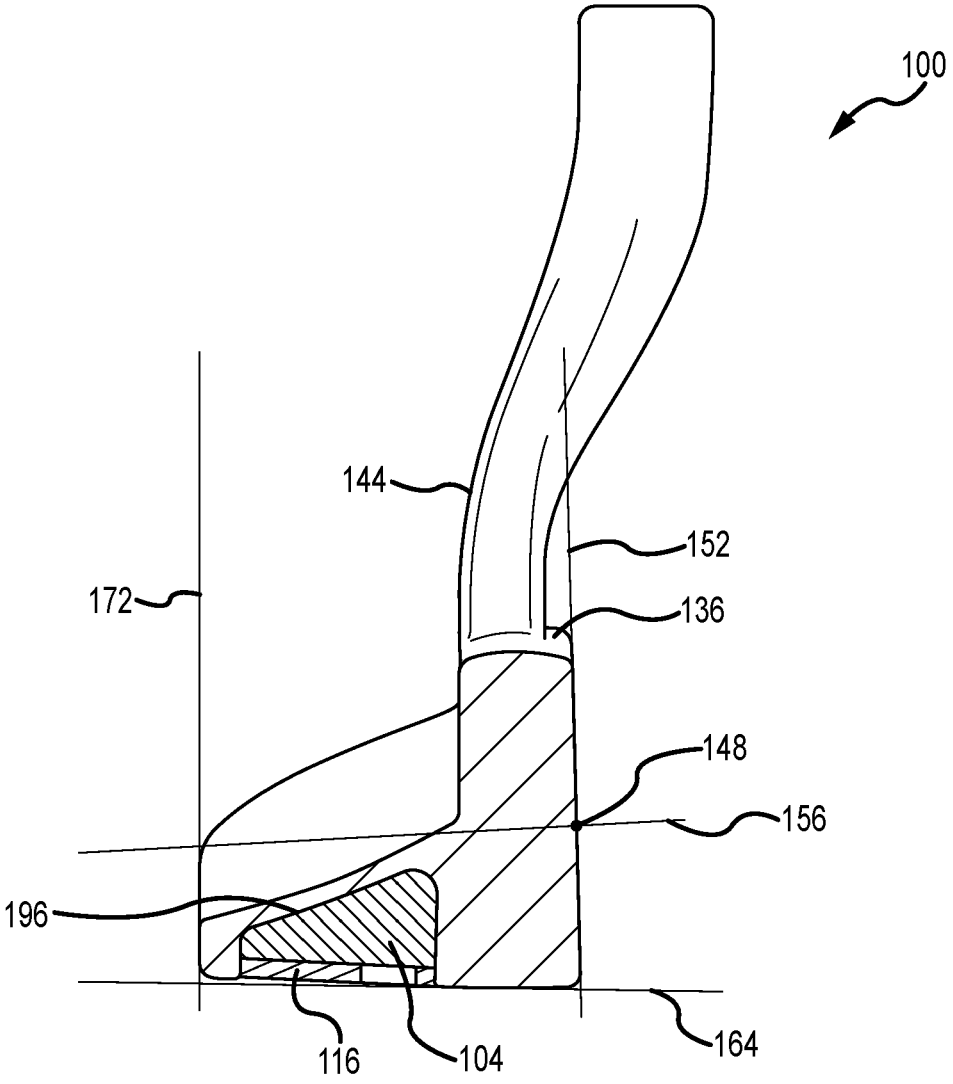
FIG. 5 illustrates another cross-section view of the putter type golf club head with elastomer fill of FIG. 1.
Figure 6:
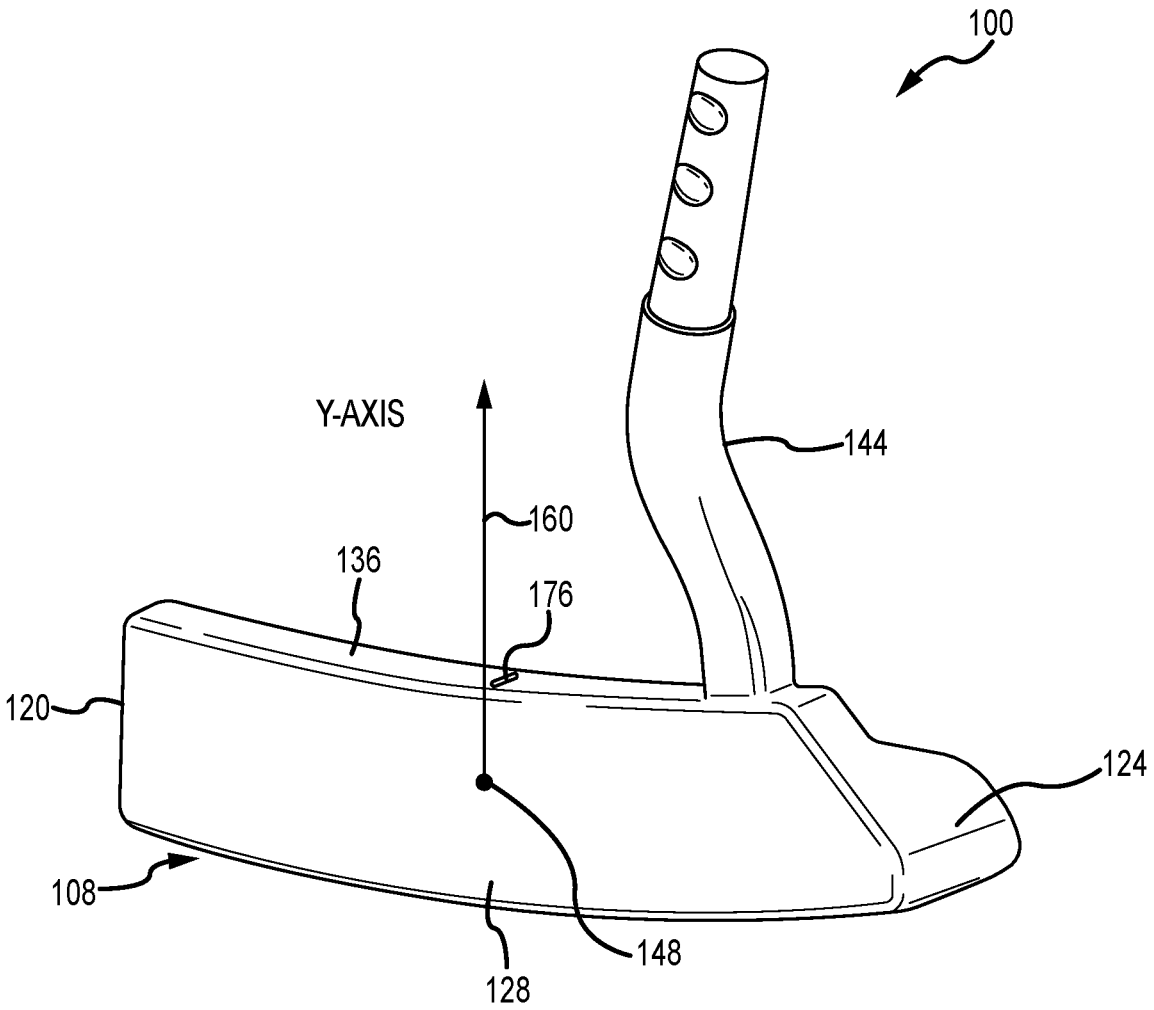
FIG. 6 illustrates a front view of the putter type golf club head with elastomer fill of FIG. 1.

Referring to FIGS. 1, 4, and 5, the golf club head 100 has a soleplate 116. The soleplate 116 comprises one or more apertures 200, an outer surface 204, an inner surface (not pictured), a length, a width, a thickness, and a mass. The soleplate 116 is affixed to the cavity 112, so that the outer surface 204 of the soleplate 116 is flush with the sole 140. The soleplate 116 is positioned tangent to the ground plane 164. In some embodiments, the shape of the soleplate 116 can be perfectly flat, can have a slight arch in a heel 124 to toe 120 direction, or can have a strong arch in the heel 124 to toe 120 direction. The soleplate 116 functions to enclose the cavity 112 and secure the elastomer fill 104 that is displaced within the cavity 112.

The one or more apertures 200 are perpendicular to the soleplate 116 and span through the outer surface 204 and inner surface of the soleplate 116. The apertures 200 can be any desired geometry (e.g., circular, square, rectangular, triangular, etc.) that provide an opening for the elastomer fill 104 to enter the cavity 112 through. In some embodiments, the soleplate 116 can comprise 1 aperture, 2 apertures, 3 apertures, 4 apertures, 5 apertures, 6 apertures, or more. Further, the apertures 200 can be positioned in any of the following locations: more near the general center of the soleplate 116, more near the toe end 120 of the soleplate 116, more near the heel end 124 of the soleplate 116, more near the rear periphery 132, more near the strike face 128, equidistant apart from one another, and/or positioned any distance from one another.

The length of the soleplate 116 is measured in a heel 124 to toe 120 direction. The length of the soleplate 116 is complimentary to the length of the cavity 112. In some embodiments, the length of the cavity 112 in the putter body 108 can range from 0.50 inches to 3.5 inches. In other embodiments, the length of soleplate 116 in the putter body 108 can range from 0.50 inches-1.0 inches, 1.0 inches-1.5 inches, 1.5 inches-2.0 inches, 2.0 inches-2.5 inches, 2.5 inches-3.0 inches, or 3.0 inches-3.5 inches. In one embodiment, the length of the soleplate 116 ranges between 2.0 inches and 2.5 inches.

The width of the soleplate 116 is measured in a rear periphery 132 to strike face 128 direction. The width of the soleplate 116 is complimentary to the width of the cavity 112. In some embodiments, the width of the soleplate 116 can range from 0.125 inches to 1.00 inches. In other embodiments, the width of the soleplate 116 can range from 0.125 inches-0.250 inches, 0.250 inches-0.375 inches, 0.375 inches-0.500 inches, 0.500 inches-0.625 inches, 0.625 inches-0.750 inches, 0.750 inches-0.875 inches, 0.875 inches-1.000 inches. In one embodiment, the width of the soleplate 116 can range between 0.500 inches and 0.625 inches The thickness of the soleplate 116 is measured from the outer surface 204 of the soleplate 116 to the inner surface of the soleplate 116. In some embodiments, the thickness of the soleplate 116 varies in across the length of the soleplate 116. In other embodiments, the thickness of the soleplate 116 is constant across the length of the soleplate 116. In some embodiments, the thickness of the soleplate 116 can range between 0.025 inches-0.250 inches. In other embodiments, the thickness of the soleplate 116 can range between 0.025 inches-0.050 inches, 0.050 inches-0.075 inches, 0.075 inches-0.100 inches, 0.100 inches-0.125 inches, 0.0125 inches-0.150 inches, 0.150 inches-0.175 inches, 0.175 inches-0.200 inches, 0.200 inches-0.225 inches, or 0.225 inches-0.250 inches.

In some embodiments, the soleplate 116 can be made of any one or combination of the following: 8620 alloy steel, S25C steel, carbon steel, maraging steel, 17-4 stainless steel, 1380 stainless steel, 303 stainless steel, stainless steel alloy, tungsten, aluminum, aluminum alloy, or any metal suitable for creating a golf club head. In one embodiment, the soleplate 116 is made of 1380 stainless steel or 303 stainless steel.

Furthermore, the soleplate 116 has a mass that can range between 2 grams-20 grams. In some embodiments, the mass of the soleplate 116 can range from 2-3 grams, 3-4 grams, 4-5 grams, 5-6 grams, 6-7 grams, 7-8 grams, 8-9 grams, 9-10 grams, 10 grams-11 grams, 11 grams-12 grams, 12 grams-13 grams, 13 grams-14 grams, 14 grams-15 grams, 15 grams-16 grams, 16 grams-17 grams, 17 grams-18 grams, 18 grams-19 grams, or 19 grams-20 grams.

IV. Elastomer Fill

Referring to FIGS. 1-7, the elastomer fill 104 is a liquid elastomer that is within the cavity 112 of the putter body 108. It can be used as an insert before the soleplate 116 is attached or it can be injected through the one more apertures 200 into the cavity 112. The liquid elastomer is injected into the cavity 112, at a high temperature, but as the liquid settles and cools, the liquid elastomer gelatinizes into a semi-solid suspension or a solid. The addition of the elastomer fill 104 can improve the MOI, CG, and weighting of the putter body 108. Further, the elastomer fill 104 can improve the sound and feel of the putter body 108, when striking a golf ball, due to the vibration dampening characteristic of the material.

The elastomer fill 104 is made of a second material or combination of a second material and another similar material. The second material of the elastomer fill 104 can be any one of or combination of the following: rubber, synthetic rubber, thermoplastic polyurethane, thermoplastic elastomers, thermoset urethanes, agar hydrocolloids, alginate hydrocolloids, or any lightweight polymer-type material. In one embodiment, the elastomer fill 104 can be an agar hydrocolloid, wherein the agar hydrocolloid gel comprises: 80-88% water, 10-18% agar, 0-1% potassium sulfate, 0-0.5% borax, and 0-0.5% alkyl benzoate.

Since the elastomer fill 104 can be a variety of materials, the elastomer fill 104 can have a varying mass. In some embodiments, the mass of the elastomer fill 104 can range from 1 gram-15 grams. In other embodiments, the mass of the elastomer fill 104 can range from 1 gram-2 grams, 2-3 grams, 3-4 grams, 4-5 grams, 5-6 grams, 6-7 grams, 7-8 grams, 8-9 grams, 9-10 grams, 10 grams-11 grams, 11 grams-12 grams, 12 grams-13 grams, 13 grams-14 grams, or 14 grams-15 grams.

Further, the elastomer fill 104 can occupy a portion of the cavity 112 or the entire cavity 112. In some embodiments, the elastomer fill 104 can occupy a range of 20% to 100% of the cavity 112. In other embodiments, the elastomer fill 104 can occupy a range of 20%-25%, 25%-30%, 30%-35%, 35%-40%, 40%-45%, 45%-50%, 55%-60%, 60%-65%, 65%-70%, 70%-75%, 75%-80%, 80%-85%, 85%-90%, 90%, or 95%-100% of the cavity 112.

Furthermore, the elastomer fill 104 can comprise one or more suspended members 208, positioned within the elastomer fill 104. The suspended members 208 do not touch the front wall 180, back wall 184, heel side wall 196 or toe side wall 192 of the cavity 112. The elastomer fill 104 completely surrounds the suspended members 208. In some embodiments, the one or more suspended members 208 can comprise one suspended member, two suspended members, three suspended members, four suspended members, five suspended members, or more suspended members 208.

The suspended members 208 can be positioned in the fill near the heel end 124 and toe end 120 of the cavity 112, to further concentrate the weight towards the heel end 124 and toe end 120 of the putter body 108. In other embodiments, the suspended members 208 can be positioned in the elastomer fill 104 in any of the following locations: more near the general center of the soleplate 116, more near the toe end 120 of the cavity 112, more near the heel end 124 of the soleplate 116, more near the rear periphery 132, more near the strike face 128, equidistant apart from one another, and/or positioned any distance from one another.

The suspended members 208 are made of a third material or combination of a third material and another metal. The third material of the suspended members 208 can be any one of or combination of the following: 8620 alloy steel, S25C steel, carbon steel, maraging steel, 17-4 stainless steel, 1380 stainless steel, 303 stainless steel, stainless steel alloy, tungsten, aluminum, aluminum alloy, thermoplastic polyurethane, brass, bronze, copper, or any other suitable material. Further, the suspended members 208 can be any shape (e.g., cube, sphere, cylinder, etc.).

Further, the suspended members 208 comprise a mass. In some embodiments, the mass of the suspended members 208 can range from 1 gram-15 grams. In other embodiments, the mass of the suspended members 208 can range from 1 gram-2 grams, 2-3 grams, 3-4 grams, 4-5 grams, 5-6 grams, 6-7 grams, 7-8 grams, 8-9 grams, 9-10 grams, 10 grams-11 grams, 11 grams-12 grams, 12 grams-13 grams, 13 grams-14 grams, or 14 grams-15 grams.

V. Method of Manufacture

The method of manufacturing a putter golf club head 100 with elastomer fill 104 comprises four stages: the golf club head 100 with a cavity 112 in the sole 140 is formed, a soleplate 116 with at one or more apertures 200 is affixed over the cavity 112, the putter body 108 is coated with a finishing technique, and the cavity 112 is filled with an elastomer fill 104 through at the one or more apertures 200.

To begin the process, a block of material is provided. The block of material can be any one or more combination of the following: 8620 alloy steel, S25C steel, carbon steel, maraging steel, 17-4 stainless steel, 1380 stainless steel, 303 stainless steel, stainless steel alloy, tungsten, aluminum, aluminum alloy, or any metal suitable for creating a golf club head 100. In some embodiments, the putter body 108 and the hosel 144 of the golf club head 100 can be made from the same block of material. In other embodiments, the putter body 108 and the hosel 144 of the golf club head 100 can be made from separate blocks of material and welded together to form the golf club head 100.

Next, the block of material is milled into a golf club head 100 with a cavity 112 perpendicular to the sole 140. The milling process uses a computer numerical control (CNC) to guide a rotating metal tool to cut or shape a block into a desirable shape. Since milling utilizes programmable machine parameters, the process produces a precise golf club head 100, with tight machined tolerances. Furthermore, the golf club head 100 produced by the milling technique does not require any post-milling modifications (e.g. machining, shaving off excess material). In other embodiments, the putter type golf club head 100 can be casted, molded, co-molded, machined, or forged by any other manufacturing process.

Following the milling process, a soleplate 116 is affixed over the cavity 112, and is flush with the sole 140 of the putter body 108. The soleplate 116 can be affixed over the cavity 112 by any one or combination of the following: welding, soldering, brazing, swedging, adhesion, epoxy, or mechanical fastening. In one embodiment, the soleplate 116 can be welded to the toe side wall 192, heel side wall 196, front wall 180, and back wall 184 of the cavity 112. The soleplate 116 is affixed to the cavity 112 prior, to filling the cavity 112 with elastomer fill 104 in the following step. The elastomer fill 104 is inserted into the cavity 112 in liquid form, therefore the soleplate 116 prevents the liquid elastomer fill 104 from spilling out of the cavity 112. After the soleplate 116 is secured to the putter body 108, the soleplate 116 is smoothed down to guarantee that the soleplate 116 is perfectly flush with the sole 140.

Following the attachment of the soleplate 116 to the putter body 108, the club head 100 undergoes a finishing process. The finishing process adds a thin layer to the golf club head 100, to protect the putter body 108 and the soleplate 116 from abrasion, corrosion, and impact. The finishing process can be a powder coating, a chrome plating bath, a nickel-plating bath, a glare reducing finish, a matte finish, or any other suitable finishing for a putter type golf club head. Further, the finish improves the seal at the junction of the soleplate 116 and the putter body 108, preventing the elastomer fill 104 from leaking in the following step. The finishing process takes place prior to inserting the elastomer fill 104, so that the physical properties of the elastomer fill 104 are not affected by any heat involved in the finishing process.

Once the golf club head 100 has undergone the coating process, the elastomer fill 104 is injected into the cavity 112. The elastomer fill 104 is injected through the one or more apertures 200 of the soleplate 116 to fill a portion of, or the entirety of, the cavity 112. In some embodiments, the elastomer fill 104 can be made of any one or combination of the following: rubber, synthetic rubber, thermoplastic polyurethane, thermoplastic elastomers, thermoset urethanes, agar hydrocolloids, alginate hydrocolloids, or any lightweight polymer-type material. In one embodiment, the elastomer can be an agar hydrocolloid, wherein the agar hydrocolloid gel comprises: 80-88% water, 10-18% agar, 0-1% potassium sulfate, 0-0.5% borax, and 0-0.5% alkyl benzoate. Once the elastomer fill 104 is injected into the cavity 112, the golf club head 100 is set to cool, allowing the liquid elastomer to solidify.

In some embodiments, the golf club head 100 can further comprise one or more suspended members 208 within the elastomer fill 104. In one embodiment, the suspended members 208 are inserted into the cavity 112 of the putter body 108 through the one or more apertures 200 of the soleplate 116, after the elastomer fill 104 has been injected, but prior to the elastomer fill 104 solidifying. In other embodiments, the one or more suspended members 208 can be inserted prior to the elastomer fill 104 being injected. Further, in another embodiment, the one or more suspended members 208 can be inserted, the elastomer fill 104 can be injected, stops can be placed over the apertures of the soleplate 116, and then the golf club head 100 can be rested to cool on the sole 104, allowing the one or more suspended members 208 to shift downwards until the elastomer fill 104 hardens. The positioning of the one or more suspended members 208 can be controlled by varying and combining the physical properties of the one or more suspended members 208 and the elastomer fill 104 (e.g., viscosity, hardening time, density).

The enclosed method of manufacturing produces a fully milled putter head with an undercut cavity 112 and elastomer fill 104, that has improved CG and MOI characteristics to improve the feel, sound, and consistency of striking a golf ball. By creating a fully milled putter body 108 with an undercut cavity 112, tighter tolerances are achieved, thus saving manufacturing time and cost, since no other machining techniques are needed to form the cavity 112 or golf club head 100. Further, milling eliminates human error, variance, and/or damage of the golf club head 100 due to additional machining techniques. Furthermore, by attaching a soleplate 116 over a precision milled cavity 112, and then filling the cavity 112 with liquid elastomer, an exact elastomer insert is formed to compliment the cavity 112. This process reduces manufacturing time and cost, since no shaping or forming of the elastomer fill 104 is needed.

VI. Performance of Putter Type Golf Club Head

The putter type golf club head 100 provides unexpected benefits of improved MOI, CG, feel, and weighting, without using mechanically fastened weights or weight ports. By milling a putter type golf club head 100 with an integrally formed cavity 112 in the sole 140, the weighting of the club head 100 shifts towards the heel end 124 and toe end 120 of the putter body 108, without any weight ports or attachments to the heel end 124 and toe end 120 of the putter body 108. This shift in weight towards the heel end 124 and toe end 120 of the putter body 108 raises the MOI of the club head 100 about the y-axis 160 (Iyy), thus preventing the rotation about the y-axis 160, assuring the strike face 128 is square to a golf ball during impact. The increase in MOI about the y-axis 160 helps achieve a straighter ball path and improve the outcome of off-centered hits (impact at the heel end 124 or toe end 120).

The cavity 112 with elastomer fill 104 creates a more solid feeling club head 100, which absorbs unwanted vibrations, and improves the sound when a golf ball is struck with the club head 100. Additionally, the elastomer fill 104 can improve the MOI about the y-axis 160 of the club head 100. When the lightweight elastomer fill 104 is in placed in the cavity 112, the MOI about the y-axis 160 increases by approximately 6.4% (MOI=661 $lb \cdot ft^2$), compared to a similar (shape, size, weight) golf club head 100 devoid of a cavity 112, soleplate 116, and elastomer fill 104 (MOI=621 $lb \cdot ft^2$). Furthermore, the addition of the elastomer fill 104 shifts the CG of the putter body 108 towards the heel end 124, toe end 120, and sole 140 of the club head 100, since the material of the club head 100 is denser than the elastomer fill 104.

In some embodiments, wherein the elastomer fill 104 contains one or more suspended members 208, the vibration characteristics of the golf club 100 can be further improved. Since the one or more suspended members 208 do not touch any part of the cavity 112, there is no rattling or collision of the one or more suspended members 208 within the cavity 112. However, since the one or more suspended members 208 are entirely encased, the one or more suspended members 208 act as vibration dampeners, by absorbing unwanted vibrations and high-pitched frequencies throughout the elastomer fill 104. In some embodiments, the suspended members 208 of the elastomer fill 104 decrease the amplitude of the vibrations experienced when striking a golf ball between 5%-15%. In other embodiments, the suspended members 208 of the elastomer fill 104 can decrease the amplitude of the vibrations experienced when striking a golf ball by 5%, 6%, 7%, 8%, 9%, 10%, 11%, 12%, 13%, 14%, or 15%.

Furthermore, the one or more suspended members 208 can optimize the CG, MOI, and weighting of the club head 100, by changing/or adjusting the material, density, or location of the members. The addition of the one or more suspended members 208 within the club head 100, increases the MOI about the y-axis 160 by approximately 6.3% (MOI=661 $lb \cdot ft^2$), compared to a similar golf club head 100 devoid of a cavity 112, soleplate 116, and elastomer fill 104 (MOI=621 $lb \cdot ft^2$).

The soleplate 116 optimizes the physical properties of the club head 100. The addition of an attachable soleplate 116 further increases the MOI about the y-axis 160 since the material and low position of the soleplate 116 shifts the CG of the club head 100 further towards the ground plane 164.

Further, the enclosed manufacturing method of a putter type golf club head 100, allows the MOI, CG, and weighting to be controlled and/or changed at multiple stages throughout the process. Since the milling processes is computer controlled, small changes in weight distribution, and cavity 112 size can be easily made to optimize the desired properties. The soleplate 116 attachment offers a second stage of the manufacturing process, in which the physical properties can be adjusted. By changing the material, density, or thickness of the soleplate 116, the MOI, CG, and weighting of the club head 100 can be easily adjusted to an optimal setting. The elastomer fill 104 injection stage offers a third and final stage of the manufacturing process, in which the physical properties can be adjusted. When the elastomer fill 104 is injected within the cavity 112, a medium is created in which the one or more suspended members 208 can be positioned, to further adjust the CG, MOI, or weighting of the golf club head 100. The manufacturing method improves the cost and efficiency of creating a golf club head 100, while allowing for the physical properties of the club head 100 to be customized, adjusted, and optimized to a desired setting.

Clause 1: A golf club head comprising a putter body having a hosel, a toe end, a heel end, a rear periphery, a top surface, a sole, a strike face, a cavity, a soleplate, an elastomer fill; wherein a rear plane is tangent to the rear periphery and perpendicular to a ground plane; wherein the strike face comprises a strike face center point that is equidistant from the top surface and sole of the putter body; a loft plane is tangent to the strike face, a midplane intersecting the strike face center point, and is perpendicular to the loft plane; wherein the cavity comprises a front wall, a back wall, a toe side wall, a heel side wall, a top wall, a height, and a width, wherein the cavity is perpendicular to the sole, wherein the height of the cavity is measured from the sole to the top wall of the cavity, wherein the width of the cavity is measured from the front wall of the cavity to the back wall of the cavity, wherein the front and back walls of the cavity do not extend to or intersect with the mid-plane wherein the side walls of the cavity do not extend to or intersect with the rear plane, wherein the side walls of the cavity do not extend to or intersect with the loft plane, wherein the front wall of the cavity has a greater height than the back wall of the cavity; the soleplate is flush with the sole of the body, and encloses the cavity; wherein the elastomer fill is partially or fully disposed within the cavity.

Clause 2: The golf club head of clause 1, wherein the top wall of the cavity has a parabolic contour.

Clause 3: The golf club head of clause 2, wherein the height of the cavity varies in a heel to toe direction.

Clause 4: The golf club head of clause 3, wherein the height of the toe side wall of the cavity is greater than the heel side wall of the cavity.

Clause 5: The golf club head of clause 1, wherein the soleplate contains one or more apertures.

Clause 6: The golf club head of clause 1, wherein the body is made of a first material.

Clause 7: The golf club head of clause 1, wherein the elastomer fill is made of a second material.

Clause 8: A golf club head comprising: a putter body having a hosel, a toe end, a heel end, a rear periphery, a top surface, a sole, a strike face, a cavity, a soleplate, an elastomer fill; wherein a rear plane is tangent to the rear periphery and perpendicular to a ground plane; wherein the strike face comprises a strike face center point that is equidistant from the top surface and sole of the putter body; a loft plane is tangent to the strike face, a midplane intersecting the strike face center point, and is perpendicular to the loft plane; wherein the cavity comprises a front wall, a back wall, a toe side wall, a heel side wall, a top wall, a height, and a width, wherein the cavity is perpendicular to the sole, wherein the height of the cavity is measured from the sole to the top wall of the cavity, wherein the width of the cavity is measured from the front wall of the cavity to the back wall of the cavity, wherein the front and back walls of the cavity do not extend to or intersect with the mid-plane, wherein the side walls of the cavity do not extend to or intersect with the rear plane, wherein the side walls of the cavity do not extend to or intersect with the loft plane, wherein the front wall of the cavity has a greater height than the back wall of the cavity; the soleplate is flush with the sole of the body, and encloses the cavity, wherein the soleplate contains one or more apertures; wherein the elastomer fill is partially or fully disposed within the cavity; and wherein one or more suspended members are displaced within the elastomer fill.

Clause 9: The golf club head of clause 8, wherein the top wall of the cavity has a parabolic contour.

Clause 10: The golf club head of clause 9, wherein the height of the cavity varies in a heel to toe direction.

Clause 11: The golf club head of clause 10, wherein the height of the toe side wall of the cavity is greater than the heel side wall of the cavity.

Clause 12: The golf club head of clause 8, wherein the body is made of a first material.

Clause 13: The golf club head of clause 8, wherein the elastomer is made of a second material.

Clause 14: The golf club head of clause 8, wherein the suspended members are made of a third material.

Clause 15: The golf club head of clause 8, wherein the suspended members are completely encased within the elastomer fill.

Clause 16: A method of forming a putter head, comprising: milling a putter head from a block of material to include a toe end, a heel end, a rear wall, a top surface, a sole, a strike face, and a cavity positioned perpendicular to the sole that extends towards the top surface; affixing a sole plate to the sole, covering the cavity, wherein the sole plate contains one or more apertures; coating the putter with a protective finish; and introducing an elastomeric fill to the cavity via injection molding through the one or more apertures.

Clause 17: The method of forming a putter head of clause 16, wherein one or more suspended members are displaced within the elastomer fill.

Clause 18: The method of forming a putter head of clause 16, wherein the soleplate contains one or more apertures.

Clause 19: The method of forming a putter head of clause 16, wherein a top wall of the cavity has a parabolic contour.

Clause 20: The method of forming a putter head of clause 16, wherein the height of the cavity varies in a heel to toe direction.

Replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

The above examples may be described in connection with a putter-type golf club, the apparatus, methods, and articles of manufacture described herein. Alternatively, the apparatus, methods, and articles of manufacture described herein may be applicable other type of sports equipment such as a hockey stick, a tennis racket, a fishing pole, a ski pole, etc.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

Various features and advantages of the disclosure are set forth in the following.

The invention claimed is:

1. A golf club head comprising:

a putter body having a hosel, a toe end, a heel end, a rear periphery, a top surface, a sole, a strike face, a cavity, the golf club head further comprising a soleplate, an elastomer fill, and one or more suspended members;

wherein the putter body comprises a first material chosen from a group consisting of: 8620 alloy steel, S25C steel, carbon steel, maraging steel, 17-4 stainless steel, 1380 stainless steel, 303 stainless steel, or other stainless steel alloy;

wherein the golf club head has a weight in range of 340 to 365 grams;

wherein a rear plane is tangent to the rear periphery and perpendicular to a ground plane;

wherein the strike face comprises a strike face center point that is equidistant from the top surface and sole of the putter body;

a loft plane is tangent to the strike face, wherein the loft plane defines a strike face loft angle between 0 degrees and 5 degrees;

a midplane intersecting the strike face center point, and is perpendicular to the loft plane;

wherein the cavity comprises a front wall, a back wall, a toe side wall, a heel side wall, a top wall, a height, and a width, wherein the cavity is perpendicular to the sole, wherein the height of the cavity is measured from the sole to the top wall of the cavity, wherein the width of the cavity is measured from the front wall of the cavity to the back wall of the cavity, wherein the front and back walls of the cavity do not extend to or intersect with the mid-plane such that the top wall does not intersect with the midplane and the entire cavity is beneath the midplane, wherein the cavity front wall is distanced from the strike face a distance in the range of 0.250 to 0.450 inches, and the cavity rear wall is a distance to the rear periphery in the range of 0.025 to 0.075 inches, such that the cavity is positioned closer to the rear periphery than to the strike face ensuring that the cavity does not affect the material properties or performance of the strike face, wherein the side walls of the cavity do not extend to or intersect with the rear plane, wherein the side walls of the cavity do not extend to or intersect with the loft plane, wherein the front wall of the cavity has a greater height than the back wall of the cavity;

the soleplate is flush with the sole of the body, and encloses the cavity;

wherein the soleplate comprises a material chosen from a group consisting of: 8620 alloy steel, S25C steel, carbon steel, maraging steel, 17-4 stainless steel, 1380 stainless steel, 303 stainless steel, other stainless steel alloys, tungsten, aluminum, or an aluminum alloy;

wherein the elastomer fill is partially or fully disposed within the cavity;

wherein the one or more suspended members each have a mass in a range of 1 gram to 15 grams;

wherein the one or more suspended members are completely surrounded by the elastomer fill.

2. The golf club head of claim 1, wherein the top wall of the cavity has a parabolic contour.

3. The golf club head of claim 2, wherein the height of the cavity varies in a heel to toe direction.

4. The golf club head of claim 3, wherein the height of the toe side wall of the cavity is greater than the heel side wall of the cavity.

5. The golf club head of claim 1, wherein the soleplate contains one or more apertures.

6. The golf club head of claim 1, wherein the body is made of a first material.

7. The golf club head of claim 1, wherein the elastomer fill is made of a second material.

8. A golf club head comprising:

a putter body having a hosel, a toe end, a heel end, a rear periphery, a top surface, a sole, a strike face, a cavity, the golf club head further comprising a soleplate, an elastomer fill, and one or more suspended members;

wherein the putter body comprises a first material chosen from a group consisting of: 8620 alloy steel, S25C steel, carbon steel, maraging steel, 17-4 stainless steel, 1380 stainless steel, 303 stainless steel, or other stainless steel alloy;

wherein the golf club head has a weight in range of 340 to 365 grams;

wherein a rear plane is tangent to the rear periphery and perpendicular to a ground plane;

wherein the strike face comprises a strike face center point that is equidistant from the top surface and sole of the putter body;

a loft plane is tangent to the strike face, wherein the loft plane defines a strike face loft angle between 0 degrees and 5 degrees;

a midplane intersecting the strike face center point, and is perpendicular to the loft plane;

wherein the cavity comprises a front wall, a back wall, a toe side wall, a heel side wall, a top wall, a height, and a width, wherein the cavity is perpendicular to the sole, wherein the height of the cavity is measured from the sole to the top wall of the cavity, wherein the width of the cavity is measured from the front wall of the cavity to the back wall of the cavity, wherein the front and back walls of the cavity do not extend to or intersect with the mid-plane such that the top wall does not intersect with the midplane and the entire cavity is beneath the midplane, wherein the cavity front wall is distanced from the strike face a distance in the range of 0.250 to 0.450 inches and the cavity rear wall is a distance to the rear periphery in the range of 0.025 to 0.075 inches, such that the cavity is positioned closer to the rear periphery than to the strike face ensuring that the cavity does not affect the material properties or performance of the strike face, wherein the side walls of the cavity do not extend to or intersect with the rear plane, wherein the side walls of the cavity do not extend to or intersect with the loft plane, wherein the front wall of the cavity has a greater height than the back wall of the cavity;

the soleplate is flush with the sole of the body, and encloses the cavity, wherein the soleplate comprises a material chosen from a group consisting of: 8620 alloy steel, S25C steel, carbon steel, maraging steel, 17-4 stainless steel, 1380 stainless steel, 303 stainless steel, other stainless steel alloys, tungsten, aluminum, or an aluminum alloy;

wherein the soleplate contains one or more apertures;

wherein the elastomer fill is partially or fully disposed within the cavity; and wherein the one or more suspended members each have a mass in a range of 1 gram to 15 grams;

wherein one or more suspended members are completely surrounded by the elastomer fill.

9. The golf club head of claim 8, wherein the top wall of the cavity has a parabolic contour.

10. The golf club head of claim 9, wherein the height of the cavity varies in a heel to toe direction.

11. The golf club head of claim 10, wherein the height of the toe side wall of the cavity is greater than the heel side wall of the cavity.

12. The golf club head of claim 8, wherein the body is made of a first material.

13. The golf club head of claim 8, wherein the elastomer is made of a second material.

14. The golf club head of claim 8, wherein the suspended members are made of a third material.

15. The golf club head of claim 8, wherein the suspended members are completely encased within the elastomer fill.

16. A method of forming a putter head, comprising:

milling a putter head body from a block of material to include a toe end, a heel end, a rear wall, a top surface, a sole, a strike face, and a cavity positioned perpendicular to the sole that extends towards the top surface;

wherein the cavity comprises a front wall, a back wall, a toe side wall, a heel side wall, a top wall, a height, and a width, and wherein the putter body comprises a first material chosen from a group consisting of: 8620 alloy steel, S25C steel, carbon steel, maraging steel, 17-4 stainless steel, 1380 stainless steel, 303 stainless steel, or other stainless steel alloy;

wherein a rear plane is tangent to the rear periphery and perpendicular to a ground plane;

wherein the strike face comprises a strike face center point that is equidistant from the top surface and sole of the putter body;

a loft plane is tangent to the strike face, wherein the loft plane defines a strike face loft angle between 0 degrees and 5 degrees;

a midplane intersecting the strike face center point, and is perpendicular to the loft plane;

wherein the front and back walls of the cavity do not extend to or intersect with the mid-plane such that the top wall does not intersect with the midplane and the entire cavity is beneath the midplane, wherein the cavity front wall is distanced from the strike face a distance in the range of 0.250 to 0.450 inches and the cavity rear wall is a distance to the rear periphery in the range of 0.025 to 0.075 inches, such that the cavity is positioned closer to the rear periphery than to the strike face ensuring that the cavity does not affect the material properties or performance of the strike face, affixing a sole plate to the sole, covering the cavity, wherein the sole plate contains one or more apertures;

wherein the soleplate comprises a material chosen from a group consisting of: 8620 alloy steel, S25C steel, carbon steel, maraging steel, 17-4 stainless steel, 1380 stainless steel, 303 stainless steel, other stainless steel alloys, tungsten, aluminum, or an aluminum alloy;

coating the putter with a protective finish; and introducing an elastomeric fill to the cavity via injection molding through the one or more apertures;

introducing one or more suspended members within the elastomer fill;

wherein the one or more suspended members each have a mass in a range of 1 gram to 15 grams;

wherein the one or more suspended members are completely surrounded by the elastomer fill.

17. The method of forming a putter head of claim 16, wherein a top wall of the cavity has a parabolic contour.

18. The method of forming a putter head of claim 16, wherein the height of the cavity varies in a heel to toe direction.

* * * * *